United States Patent [19]

Weissenfluh

[11] 4,360,736

[45] Nov. 23, 1982

[54] RADIATION SHIELD

[76] Inventor: John A. Weissenfluh, 13212 Ridge Dr., Rockville, Md. 20850

[21] Appl. No.: 140,526

[22] Filed: Apr. 15, 1980

[51] Int. Cl.[3] ..... G21F 3/02

[52] U.S. Cl. ..... 250/519.1; 250/517.1; 5/449

[58] Field of Search ..... 250/517, 519; 5/451, 5/449

[56] References Cited

U.S. PATENT DOCUMENTS

| | | | |
|---|---|---|---|
| 1,382,831 | 6/1921 | Hilker | 5/449 |
| 3,256,440 | 6/1966 | Stark | 250/519 |
| 3,256,442 | 6/1966 | Sedlak | 250/519 |
| 3,848,282 | 11/1974 | Viesturs | 5/451 |
| 4,090,087 | 5/1978 | Weissenfluh | 250/519 |
| 4,224,705 | 9/1980 | Santo | 5/451 |

*Primary Examiner*—Harold A. Dixon

*Attorney, Agent, or Firm*—Baker & McKenzie

[57] ABSTRACT

Described is a radiation shield for use in installations containing sources of radiation. The radiation shield comprises a container formed of thin flexible material and means connecting opposing walls of the container to maintain the distance therebetween when the container is filled with a radiation attenuating liquid. Two embodiments of the means are disclosed. In one embodiment, the means are drop stitches. In the other embodiment, the means are wing tabs.

2 Claims, 5 Drawing Figures

RADIATION SHIELD

TECHNICAL FIELD

This invention relates to radiation shields of the type comprising a container formed of thin flexible material filled with a radiation attenuating liquid.

BACKGROUND OF THE PRIOR ART

Radiation shields of the type comprising a container formed of thin flexible material filled with a radiation attenuating liquid were originally disclosed in my U.S. Pat. No. 4,090,087, issued May 14, 1978. Such radiation shields have come into widespread use. However, despite their popularity, their use has presented certain problems.

Radiation shields of this type now in use are simply dunnage bags—that is, large rubber bags somewhat similar in appearance to water mattresses. Such shields are satisfactory for most purposes, but they have presented some problems where dimensional accuracy and dimensional stability are problems. That is because the surfaces of the shields tend to bulge in a non-uniform and somewhat unpredictable fashion when the shield is filled with a radiation attenuating liquid.

OBJECTS OF THE INVENTION

It is, therefore, a general object of the invention to provide a radiation shield which will obviate or minimize problems of the type previously described.

It is a particular object of the invention to provide a radiation shield which maintains its dimensional accuracy and dimensional stability when the shield is filled with a radiation attenuating liquid.

Other objects and advantages of the invention will become apparent from the detailed description of a preferred embodiment given hereinafter.

BRIEF SUMMARY OF THE INVENTION

The invention is a radiation shield for use in installations containing sources of radiation. The radiation shield comprises a container formed of thin flexible material and means connecting opposing walls of the container to maintain the distance therebetween when the container is filled with a radiation attenuating liquid. Preferably, the means are either drop stitches or wing tabs.

DETAILED DESCRIPTION OF THE INVENTION

Figure 1:
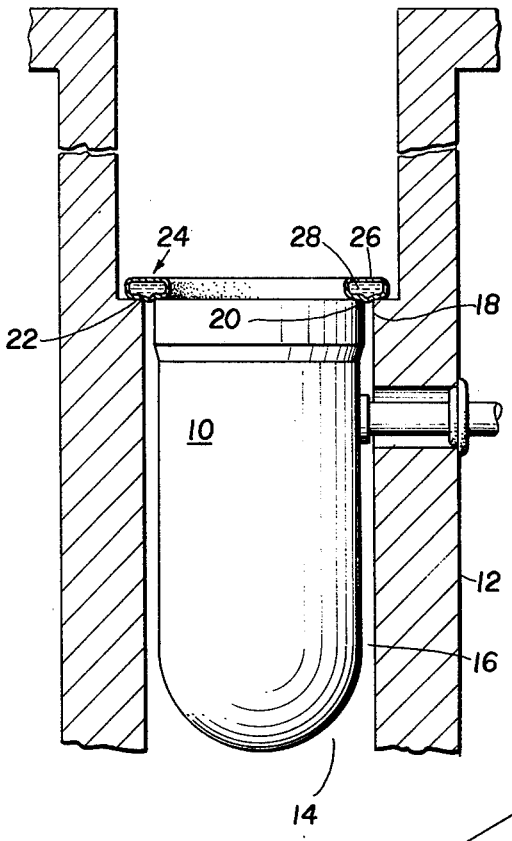
FIG. 1 is an elevational view partly in cross-section of a reactor vessel and a surrounding primary shield with a first embodiment of a radiation shield according to this invention in place.

FIG. 1 is a simplified showing of the relationship between a nuclear reactor vessel 10 and a surrounding primary shield 12. The primary shield 12 defines a reactor cavity 14. The walls of the primary shield 12 are spaced from the reactor vessel 10 to define an annular space 16 having an open upper end 18. The reactor vessel 10 has an annular ledge 20 which is adjacent to and radially inwardly disposed from an annular ledge 22 on the primary shield 12.

The upper end 18 between the annular ledges 20 and 22 is spanned by a form of the radiation shield of this invention which is generally indicated by the number 24. It comprises a container 26 formed of a thin flexible material, such as rubber or plastic, filled with a radiation attenuating liquid 28. The radiation attenuating liquid 28 is preferably a hydrogeneous liquid. The liquid serves as a moderator and absorber for neutron radiation emanating from the reactor vessel 10.

Figure 2:
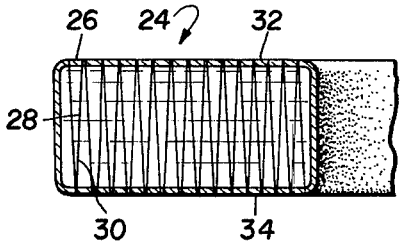
FIG. 2 is an enlarged, fragmentary cross-sectional view of the first embodiment of the subject invention.
Figure 5:
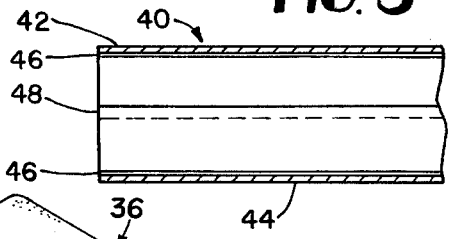
FIG. 5 is a sectional view along the line 5—5 in FIG. 4.

As shown in FIG. 2, the radiation shield 24 also comprises means 30 connecting opposing walls 32 and 34 of the container 26 to maintain the distance therebetween when the container 26 is filled with the radiation attenuating liquid 28. Since the radiation shield 24 is preferably collapsible for storage, the means 30 are preferably flexible, permitting the opposing walls 32 and 34 to approach each other when the container 24 is not filled with a radiation attenuating liquid. In the illustrated embodiment, the means 30 are drop stitches.

Figure 3:
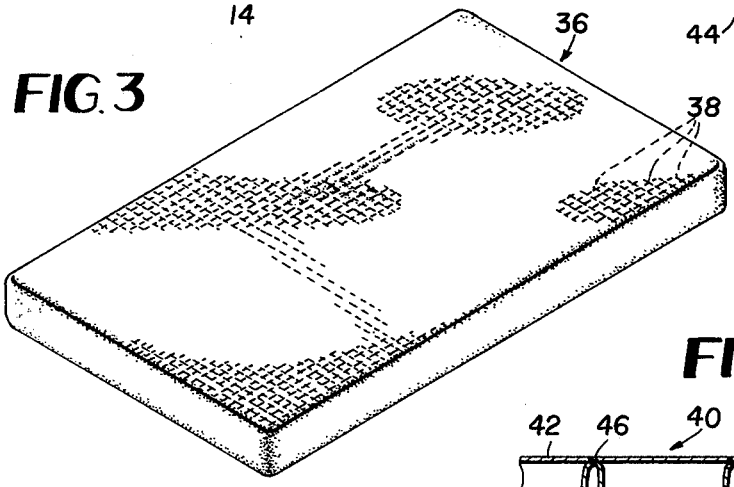
FIG. 3 is a perspective view of a second embodiment of a radiation shield according to this invention.

FIG. 3 shows a second embodiment of the subject invention. In this embodiment, the radiation shield 36 is rectangular parallelepipedal in shape—that is, it is shaped like a water mattress. An intersecting grid of drop stitches 38 is provided to maintain the distance between the major walls of the container when it is filled with a radiation attenuating fluid—or, put another way, to prevent the major surfaces of the radiation shield from bulging. As is well known in the textile art, drop stiches are threads which extend between spaced pieces of fabric and are interlaced with the threads in the spaced pieces of fabric.

Figure 4:
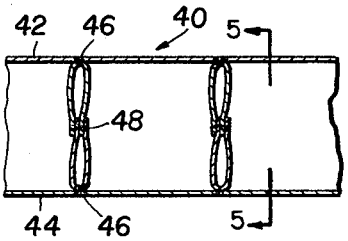
FIG. 4 is an enlarged, fragmentary, cross-sectional view of a third embodiment of the subject invention.

FIG. 4 shows a third embodiment of the subject invention. In this embodiment, the radiation shield 40 has parallel walls 42 and 44 which are each initially formed from two plies of material joined (as by stitching, heat welding, or cementing) along the nodes 46. The inner plies are cut between the nodes 46, bent inwardly, and joined along the lines 48. If desired, inserts may be placed between the inner plies, and the inner plies from each side may be joined to the inserts, thereby increasing the spacing of the outer plies. The connections between the outer plies, known as "wing tabs," also serve to maintain the distance between the major walls of the container when it is filled with a radiation attenuating fluid.

CAVEAT

While the present invention has been illustrated by detailed descriptions of three preferred embodiments thereof, it will be obvious to those skilled in the art that various changes in form and detail can be made therein without departing from the true scope of the invention. For that reason, the invention must be measured by the claims appended hereto and not by the foregoing preferred embodiments.

I claim:

1. In a radiation shield for use in installations containing sources of radiation, said radiation shield comprising a container formed of thin flexible material composed of woven or knitted threads, the improvement wherein said radiation shield further comprises means connecting opposing walls of said container to maintain the distance therebetween when said container is filled with a radiation attenuating liquid, said means being sufficiently flexible to permit opposing walls of said container to approach each other for storage when said container is not filled with a radiation attenuating liquid, said means comprising drop stitches, said drop stitches comprising an intersecting grid of threads which extend between said opposing walls and are interlaced with the threads which compose said opposing walls.

2. In a radiation shield for use in installations containing sources of radiation, said radiation shield comprising a container formed of thin flexible material, the improvement wherein said radiation shield further comprises means connecting opposing walls of said container to maintain the distance therebetween when said container is filled with a radiation attenuating liquid, said means being sufficiently flexible to permit opposing walls of said container to approach each other for storage when said container is not filled with a radiation attenuating liquid, said means comprising wing tabs, said wing tabs comprising plies of material which are initially joined to said opposing walls along a plurality of nodes, after which said plies are cut between the nodes, bent inwardly, and joined to a correspondingly inwardly bent ply segment from the opposing wall.

* * * * *